US010744534B2

(12) United States Patent
Colson et al.

(10) Patent No.: US 10,744,534 B2
(45) Date of Patent: Aug. 18, 2020

(54) CLASSIFIER AND METHOD FOR SEPARATING PARTICLES

(71) Applicant: GENERAL ELECTRIC TECHNOLOGY GMBH, Baden (CH)

(72) Inventors: Paul Colson, Westfield, MA (US); Douglas Crafts, Longmeadow, MA (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 686 days.

(21) Appl. No.: 15/367,485

(22) Filed: Dec. 2, 2016

(65) Prior Publication Data

US 2018/0154395 A1 Jun. 7, 2018

(51) Int. Cl.

| | |
|---|---|
| ***B07B 7/083*** | (2006.01) |
| ***B07B 11/08*** | (2006.01) |
| ***B02C 15/00*** | (2006.01) |
| ***B02C 23/08*** | (2006.01) |
| ***F23K 1/00*** | (2006.01) |

(52) U.S. Cl.

CPC ..... *B07B 7/083* (2013.01); *B02C 15/007* (2013.01); *B02C 23/08* (2013.01); *B07B 11/08* (2013.01); *F23K 1/00* (2013.01); *B02C 2015/002* (2013.01); *F23K 2201/10* (2013.01)

(58) Field of Classification Search

CPC ..... B07B 7/083; B07B 11/08; B02C 15/007; B02C 23/08; B02C 2015/002; F23K 1/00; F23K 2201/10

See application file for complete search history.

(56) References Cited

U.S. PATENT DOCUMENTS

| | | | | |
|---|---|---|---|---|
| 5,025,930 | A | 6/1991 | Barthelmess | |
| 5,120,431 | A | 6/1992 | Cordonnier | |
| 5,263,655 | A | 11/1993 | Glammaruti et al. | |
| 5,657,877 | A | 8/1997 | Yoshida et al. | |
| 5,819,947 | A | 10/1998 | Nardi et al. | |
| 5,884,776 | A | 3/1999 | Piepho et al. | |
| 5,957,300 | A * | 9/1999 | Nardi | B02C 15/001 209/139.2 |
| 6,290,071 | B1 * | 9/2001 | Fisher | B07B 7/083 209/713 |

(Continued)

FOREIGN PATENT DOCUMENTS

| | | | |
|---|---|---|---|
| EP | 0 496 124 | A1 | 7/1992 |
| EP | 0812623 | A1 | 12/1998 |
| JP | 2016-101557 | A | 6/2016 |

OTHER PUBLICATIONS

International Search Report and Written Opinion issued in connection with corresponding PCT Application No. PCT/EP2017/080868 dated Mar. 21, 2018.

*Primary Examiner* — Omar Flores Sanchez
(74) *Attorney, Agent, or Firm* — Grogan, Tuccillo & Vanderleeden, LLP

(57) ABSTRACT

A classifier for separating particles is provided. The classifier includes a rotor having a direction of rotation defined by a rotational axis of the rotor, and a plurality of blades disposed on the rotor around the rotational axis. At least one blade of the plurality has a swept orientation in the direction of rotation. The at least one blade is arranged to contact and direct the particles away from the classifier and thereby restrict the particles from concentrating in areas adjacent to the classifier.

17 Claims, 10 Drawing Sheets

(56) References Cited

U.S. PATENT DOCUMENTS

| | | | | |
|---|---|---|---|---|
| 6,827,221 | B1 | 12/2004 | Brundick et al. | |
| 6,902,126 | B2 | 6/2005 | Chen et al. | |
| 7,156,235 | B2 | 1/2007 | Eisinger | |
| 9,981,290 | B2 * | 5/2018 | Goosen | B07B 7/086 |
| 2002/0033357 | A1 * | 3/2002 | Keuschnigg | B07B 7/083 209/143 |
| 2013/0055935 | A1 * | 3/2013 | Takeuchi | B02C 15/007 110/232 |
| 2013/0200187 | A1 * | 8/2013 | Wark | B07B 7/083 241/68 |
| 2015/0196934 | A1 | 7/2015 | Daimaru et al. | |
| 2016/0207070 | A1 | 7/2016 | Goosen et al. | |
| 2017/0320064 | A1 * | 11/2017 | Matsumoto | B02C 23/30 |
| 2019/0168263 | A1 * | 6/2019 | Galk | B07B 7/083 |
| 2019/0291138 | A1 * | 9/2019 | Giersemehl | B02C 23/30 |

* cited by examiner

CLASSIFIER AND METHOD FOR SEPARATING PARTICLES

BACKGROUND

Technical Field

Embodiments of the invention relate generally to separating particles, and more specifically, to a classifier and method for separating particles.

Discussion of Art

Pulverizer mills are devices that grind a material up into particles. For example, many pulverizer mills grind solid fuels, e.g., coal, prior to combustion of the fuels in a boiler of a power plant. Many such pulverizer mills grind solid fuels via grinding rollers that crush the fuels against a hard rotating concave surface known as a "bowl." The grinding rollers are attached to journal assemblies via bearings which allow the grinding rollers to rotate. The journal assemblies also apply a downward force to the grinding rollers. When a solid fuel is placed into the bowl, the rotation of the bowl causes the solid fuel to move under the grinding rollers, which in turn causes the grinding rollers to rotate in place. Due to the downward force applied by the journal assemblies, the solid fuel is crushed/pulverized by the grinding rollers.

The pulverized fuel is then forced through a classifier which allows fine particles, i.e., particles that are at or below a maximum particle size, to flow out of the pulverizer mill, and restricts coarse particles, i.e., particles that are above the maximum particle size, from leaving the pulverizer mill. The maximum size of particles allowed to flow/pass through a classifier is known as the "fineness grade" of the classifier, wherein a "high fineness grade" has a maximum particle size that is smaller than a "low fineness grade." In other words, the fineness grade of a classifier is a controlled distribution of the particles sizes allowed to flow out of the pulverizer mill.

Many pulverizers include "dynamic classifiers" which utilize rotating rotors having blades to facilitate separation of fine particles from coarse particles. The blades of such rotors are typically flat and/or vertically aligned with the rotational axis of the rotor. As such, the blades of many dynamic classifiers usually deflect coarse particles outward from the classifier along a horizontal plane such that the deflected coarse particles have no direct return path back to the bowl. As such, the deflected particles often interact with other particles of the pulverized fuel to form swirls/turbulence, i.e., a dense concentration of particles in the upper regions of the encompassing pulverizer mill. Such swirls, however, often result in wear, e.g., corrosion, erosion, abrasion, and/or other forms of damage, to the classifier and/or other components of the pulverizer mill, which is costly and time consuming to repair. Such swirls may also reduce the performance of the pulverizer mill by increasing the pressure drop across the dynamic classifier, and/or impeding the ability of particles deflected by the dynamic classifier to return back to the bowl so that they can be ground to a size compliant with the finesse grade of the dynamic classifier.

Moreover, the blades of many dynamic classifiers do not provide for adequate regulation and/or adjustment of the amount/rate of fine particles allowed to pass through the classifier.

What is needed, therefore, is an improved system and method for separating particles.

BRIEF DESCRIPTION

In an embodiment, a classifier for separating particles is provided. The classifier includes a rotor having a direction of rotation defined by a rotational axis of the rotor, and a plurality of blades disposed on the rotor around the rotational axis. At least one blade of the plurality has a swept orientation in the direction of rotation. The at least one blade is arranged to contact and direct the particles away from the classifier and thereby restrict the particles from concentrating in areas adjacent to the classifier.

In another embodiment, a method for separating particles is provided. The method includes: forcing the particles against an upstream side of a classifier that includes a rotor and a plurality of blades disposed on the rotor around a rotational axis of the rotor that defines a direction of rotation of the rotor; rotating the rotor in the direction of rotation such that a first stream of the particles flows between the plurality of blades from the upstream side to a downstream side of the classifier, and such that a second stream of the particles is restricted from flowing between the plurality of blades from the upstream side to the downstream side; and restricting the particles from concentrating in areas adjacent to the classifier via contacting the particles with at least one blade of the plurality that has a swept orientation in the direction of rotation that directs the particles away from the classifier.

In yet another embodiment, a pulverizer mill is provided. The pulverizer mill includes a classifier that includes a rotor having a direction of rotation defined by a rotational axis of the rotor. The classifier further includes a plurality of blades disposed on the rotor around the rotational axis. At least one blade of the plurality has a swept orientation in the direction of rotation. The at least one blade is arranged to contact and direct the particles away from the classifier and thereby restrict the particles from concentrating in areas adjacent to the classifier.

DRAWINGS

The present invention will be better understood from reading the following description of non-limiting embodiments, with reference to the attached drawings, wherein below:

DETAILED DESCRIPTION

Figure 1:
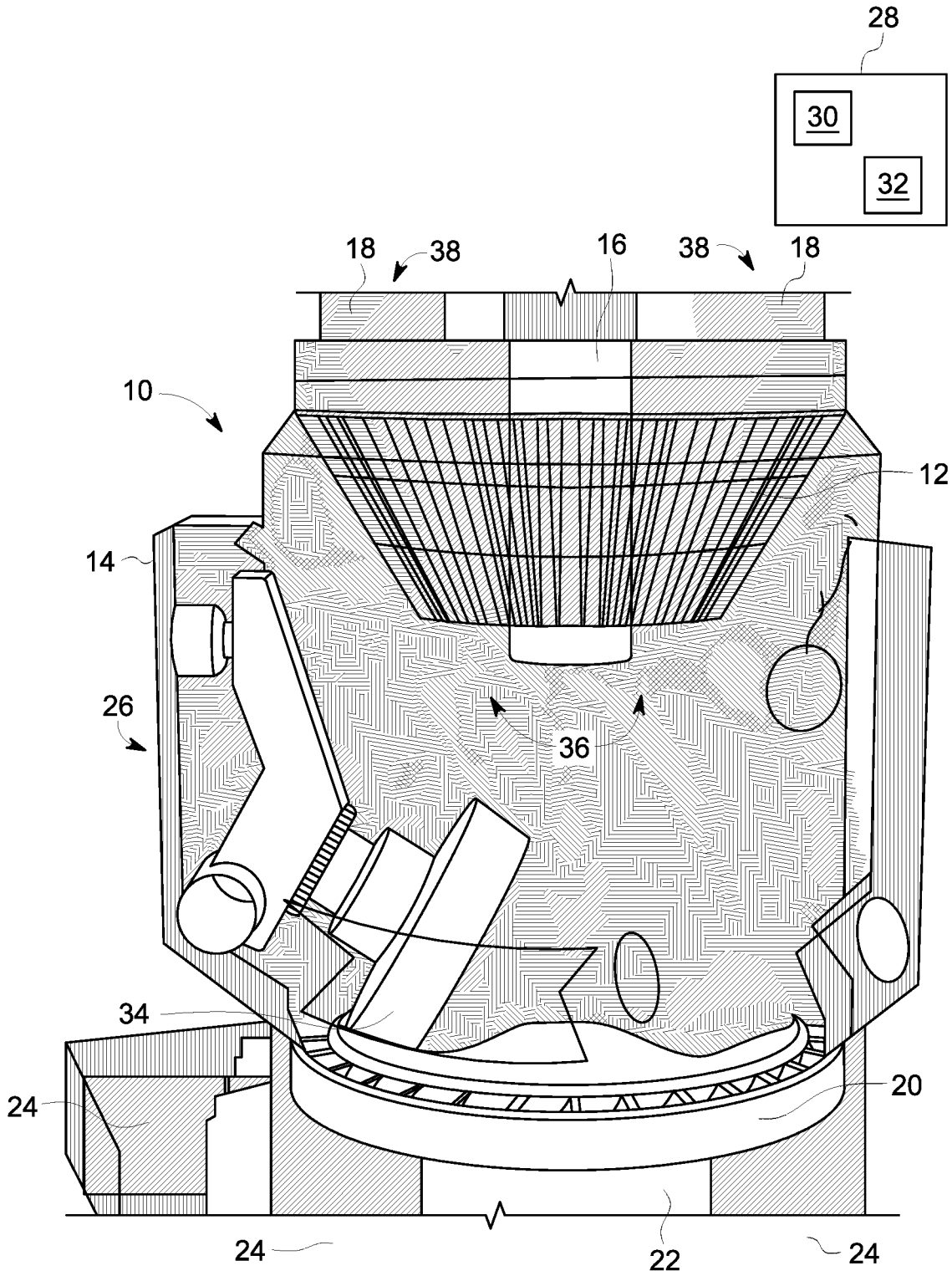
FIG. 1 is a perspective view of a pulverizer mill that includes a classifier in accordance with an embodiment of the present invention.

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. The term "real-time," as used herein, means a level of processing responsiveness that a user senses as sufficiently immediate or that enables the processor to keep up with an external process. As used herein, "electrically coupled," "electrically connected," and "electrical communication" mean that the referenced elements are directly or indirectly connected such that an electrical current, or other communication medium, may flow from one to the other. The connection may include a direct conductive connection, i.e., without an intervening capacitive, inductive or active element, an inductive connection, a capacitive connection, and/or any other suitable electrical connection. Intervening components may be present. As also used herein, the term "fluidly connected" means that the referenced elements are connected such that a fluid (to include a liquid, gas, and/or plasma) may flow from one to the other. Accordingly, the terms "upstream" and "downstream," as used herein, describe the position of the referenced elements with respect to a flow path of a fluid and/or gas flowing between and/or near the referenced elements. Further, the term "stream," as used herein with respect to particles, means a continuous or near continuous flow of particles. As also used herein, the term "heating contact" means that the referenced objects are in proximity of one another such that heat/thermal energy can transfer between them.

Additionally, while the embodiments disclosed herein are primarily described with respect to pulverizer mills for solid fuel-based power plants, e.g., coal-based power plants, it is to be understood that embodiments of the present invention may be applicable to any apparatus and/or method that benefits from the separation of particles, e.g., vertical spindle industrial mills.

Referring now to FIG. 1, a pulverizer mill 10 that includes a classifier 12 in accordance with embodiments of the present invention is shown. As shown in FIG. 1, the pulverizer mill 10 further includes a housing 14, a fuel inlet duct 16, one or more fuel outlet ducts 18, a rotating bowl 20 supported by a shaft or hub 22 turned by a motor (not shown), one or more air inlet ducts 24, at least one journal assembly 26, and a controller 28 that includes at least one processor/CPU 30 and a memory device 32. The housing 14 contains the classifier 12, bowl 20, and the journal assembly 26. The fuel inlet duct/pipe 16, the fuel outlet ducts 18, and the air inlet ducts 24 penetrate the housing 14 as shown in FIG. 1. The journal assembly 26 is mounted to the interior of the housing 20 and includes a grinding roller 34 that is configured to grind a solid fuel, e.g., coal, against the rotating bowl 20.

In embodiments, the solid fuel is deposited into the rotating bowl 20 via the fuel inlet duct 16. As the bowl 20 rotates, the solid fuel is forced under the grinding roller 34 such that a biasing force provided by a biasing component (not shown) of the journal assembly 26 enables the grinding roller 34 to crush/pulverize the solid fuel against the bowl 20. The air inlet duct 24 blows forced air up through the housing 14 such that pulverized fuel is forced against an upstream side 36 of the classifier 12 which allows fine particles to pass through to a downstream side 38 of the classifier 12. The upstream side 36 of the classifier 12 is the side of the classifier 12 that is exposed to the interior of the housing 14 and the downstream side 38 of the classifier is the side of the classifier 12 that is exposed and/or fluidly connected to the fuel outlet ducts 18. Thus, as will be appreciated, the classifier 12 allows a stream of fine particles to flow from the upstream side 36 to the downstream side 38 and into the outlet ducts 18 for subsequent consumption/combustion by a boiler (not shown), while restricting the flow/stream of coarse particles from the upstream side 36 to the downstream side 38. As will be understood, the flow of the particles within the housing is represented by the shading within FIG. 1 wherein the dark and light regions represent high and low concentrations/densities of particles, respectively, within the housing 14.

Figure 2:
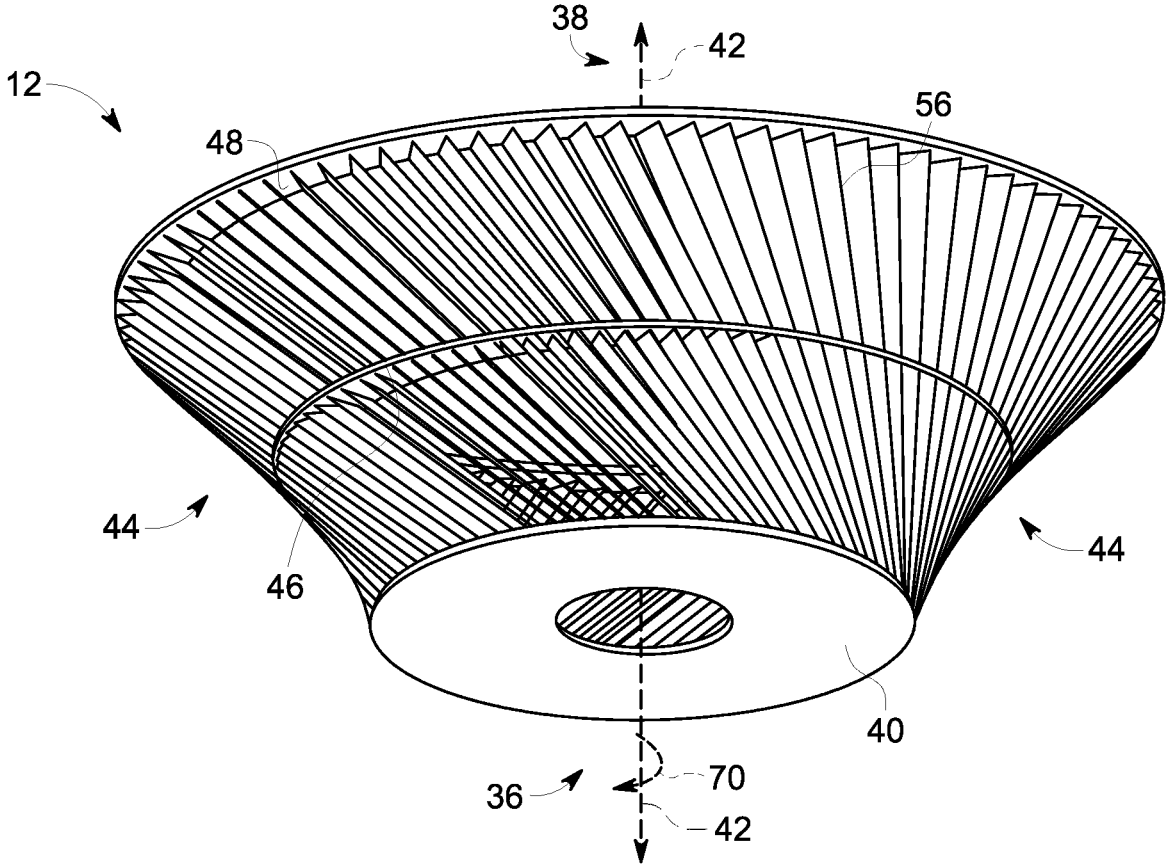
FIG. 2 is a perspective view of the classifier of FIG. 1.
Figure 3:
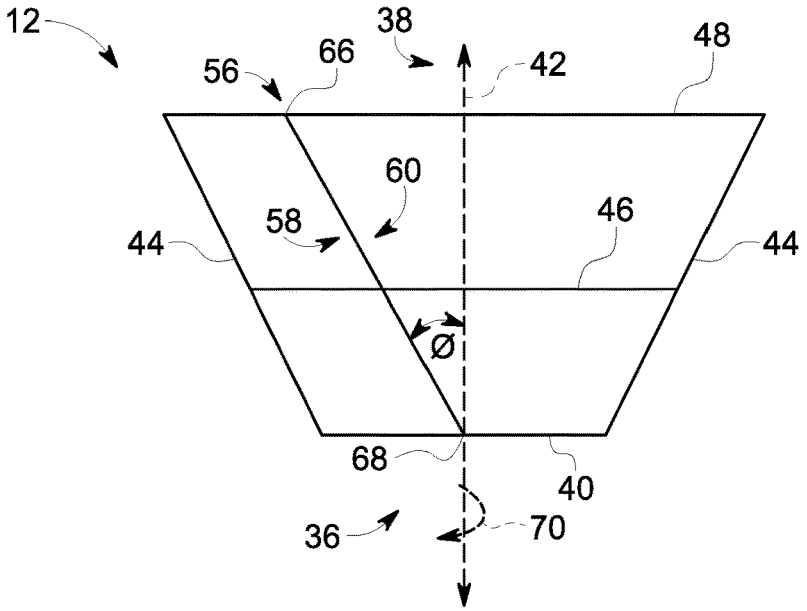
FIG. 3 is a schematic diagram of a side profile of the classifier of FIG. 1.
Figure 4:
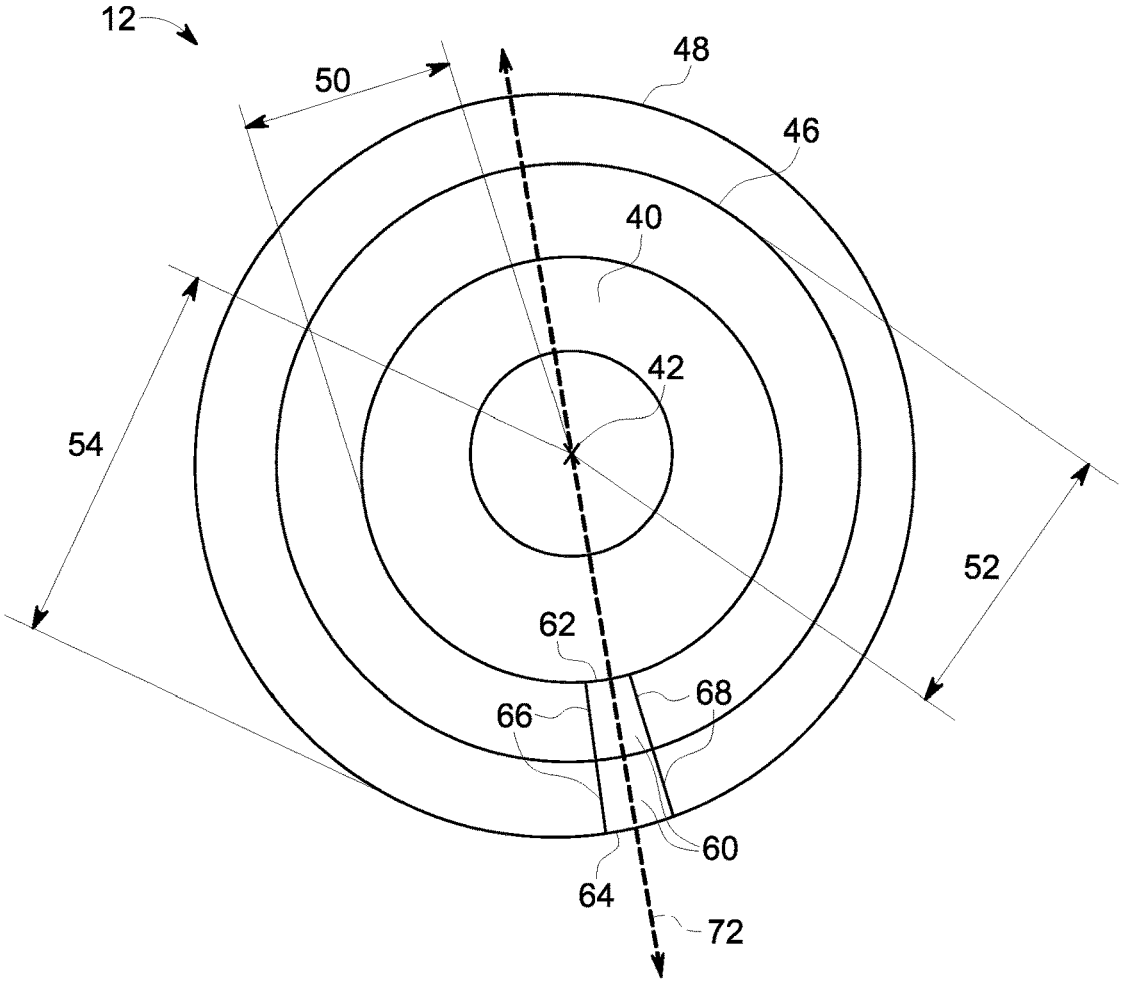
FIG. 4 is a schematic diagram of a top profile of the classifier of FIG. 1.

Turning now to FIGS. 2-4, in embodiments, the classifier 12 includes a rotor 40 having a rotational axis 42, and a plurality of blades 44 disposed/arranged on the rotor 40 around the rotational axis 42. The rotor 40 may rotate about the rotational axis 42 at speeds between 20 and 200 rotations/minute ("RPM") such that the blades 44 facilitate separation of the particles, i.e., the blades 44 use a combination of aerodynamic and physical deflection/contacting forces to separate coarse particles away from the classifier 12 while allowing fine particles to pass through. As will be understood, however, in embodiments, unlike conventional air fan blades which rely on aerodynamic forces to move objects, the primary force preventing/restricting the particles from passing through the classifier 12, i.e., between the plurality of blades 44, is the physical deflection of the particles via contacting the blades 44, as opposed to the aerodynamic forces generated by the blades 44.

In embodiments, the classifier 12 may further have one or more support rings 46 and 48 that provide structural support to the blades 44. The rotor 40 has a radius 50, which in embodiments, may be smaller than the radiuses 52 and 54 of the support rings 46 and 48, i.e., the shape of the classifier 12 may be tapered from the support rings 48 and 46 to the rotor 40 such that the blades 44 are angled outward from the rotational axis 42 as shown in FIG. 2. In embodiments, radius 50 may be between about 20 inches to 180 inches, radius 52 may be between about 21 inches to 220 inches, and radius 54 may be between about 22 inches to 240 inches.

As will be appreciated, at least one of the blades 56 of the plurality 44 has a particle control feature. As used herein, the term "particle control feature" refers to a feature operative to direct the movement of the particles so as to restrict the particles from concentrating in areas adjacent to the classifier, i.e., restrict and/or reduce the formation of swirls near the classifier 12. In particular, the particle control features described herein provide for control over the movement of particles, e.g., the pulverized fuel/coal, for the purposes of: preventing wear, i.e., corrosion, erosion, and/or abrasion; adjusting the fineness grade of the classifier 12; and/or controlling/adjusting the flow rate of fine particles across the classifier 12. Additionally, the particle control features described herein may also provide for control over the amount of tangential energy and/or downward vertical energy, e.g., centripetal force, imparted on the particles by the blade 56. Further, as will be understood, the blade 56 may include one or more of the particle control features disclosed herein.

Accordingly, the blade 56 may include a leading surface 58 and a trailing surface 60 (best seen in FIG. 3) that define an interior edge 62 and an exterior edge 64 (best seen in FIG. 4), as well as a top edge 66 and a bottom edge 68 (best seen in FIG. 3). The leading surface 58 is the side of the blade 56 that faces the direction of rotation, i.e., the leading surface 58 is the part of the blade 56 that typically first contacts the particles of pulverized fuel as the blade 56 moves in a direction of rotation (indicted by arrow 70) around the rotational axis 42. The trailing surface 60 is the part of the blade 56 that trails the leading surface 58 as the blade 56 moves around rotational axis 42. The interior 62 and exterior 64 edges are the sides of the blade 56 that face towards and away from the rotational axis 42, respectively. The top 66 and bottom 68 edges are the sides of the blade 56 that are closest/adjacent to the downstream 38 and upstream 36 sides of the classifier 12, respectively. In embodiments, the blade 56 may be flat, e.g., the distance between the leading surface 58 and the trailing surface 60 is small, e.g., about 0.125 of an inch to 1 inch.

As will be appreciated, while embodiments herein depict the direction of rotation 70 as being in the clockwise direction about the rotational axis 42, it is to be appreciated that the direction of rotation may also be in the counter-clockwise direction about the rotational axis 42.

Accordingly, and as shown in FIGS. 2-4, in embodiments, the particle control feature may be a swept orientation of the blade 56 in a direction of rotation 70 about the rotational axis 42, i.e., the rotor 40 has a direction of rotation 70 defined by the rotational axis 42. The term "swept" as used herein with respect to the orientation of the blade 56, means that the leading surface 58 is angled, i.e., not perpendicular, with respect the direction of rotation 70. For example, in embodiments, the blade 56 may be disposed/arranged at an angle Ø with respect to the rotational axis 42 such that the top edge 66 leads the bottom edge 68 as the blade 56 moves in the direction of rotation 70, i.e., the top edge 66 is swept forward of the bottom edge 68 such that the leading surface 58 is angled down, i.e., towards/facing the upstream side 36 of the classifier 12. In embodiments Ø may be between about 5° to 80°.

As will be appreciated, in embodiments, the leading surface 58 may deflect coarse particles down and towards the bowl 20 where they may be further processed/pulverized/ground, which in turn, may prevent/restrict swirls from developing in the upper regions of the housing 14. As will be understood, while the embodiments shown in the accompanying figures depict the blade 56 swept such that the leading surface 58 is angled down, in embodiments, the blade 56 may be swept such that the leading surface 58 is angled up, i.e., towards the downstream side 38 of the classifier 12 such that bottom edge 68 leads the top edge 66 as the blade 56 moves around the rotational axis 42.

Figure 5:
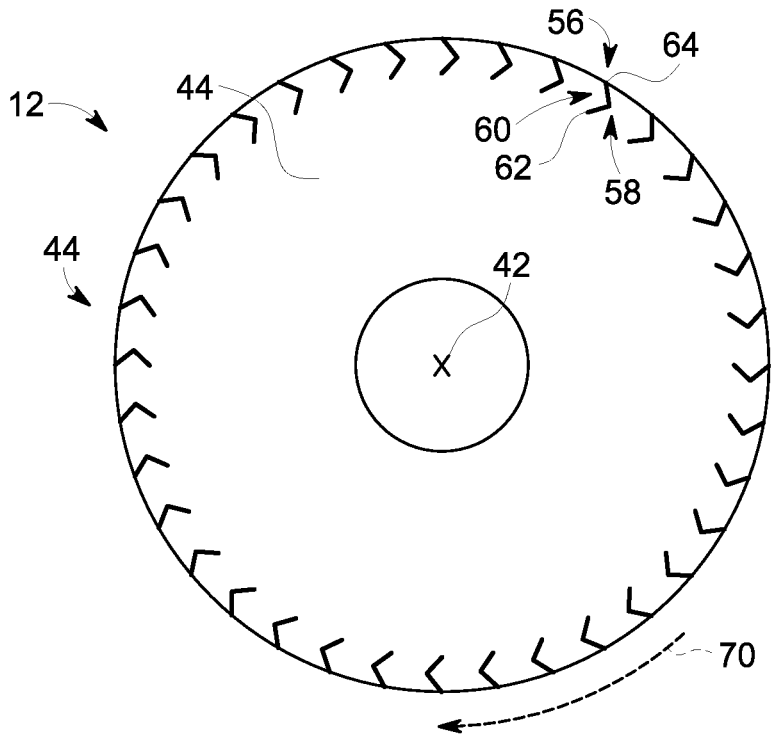
FIG. 5 is another schematic diagram of the top profile of the classifier of FIG. 1, wherein the classifier has a blade having an angled shape in accordance with an embodiment of the present invention.
Figure 6:
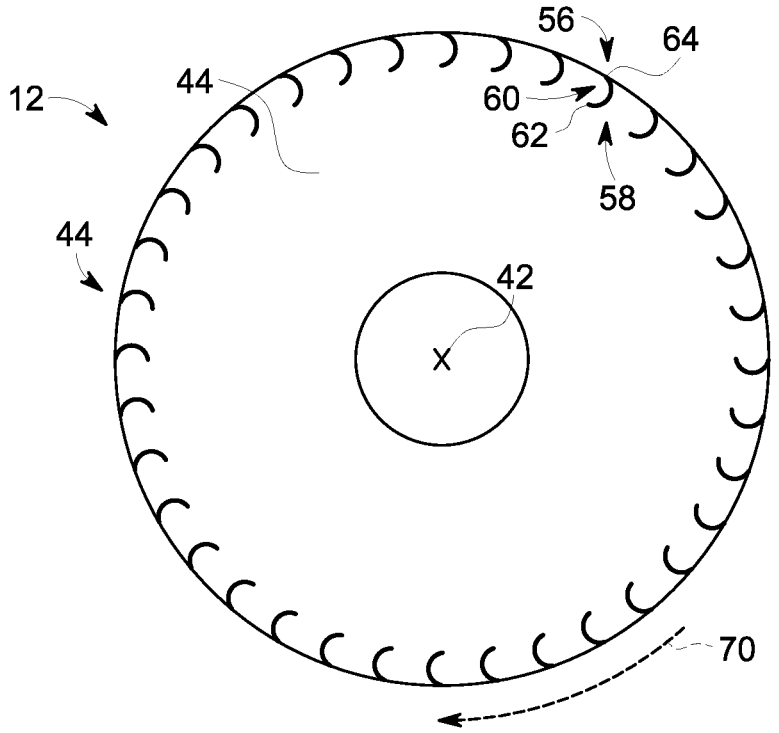
FIG. 6 is another schematic diagram of the top profile of the classifier of FIG. 1, wherein the classifier has a blade having a curved shape in accordance with an embodiment of the present invention.

As illustrated in FIGS. 5 and 6, in embodiments, the particle control feature may be a shaped leading surface 58, i.e., a shape of the leading surface 58 of the blade 56. For example, the leading surface 58 may have an angled shape (FIG. 5), e.g., the leading 58 and/or trailing 60 surfaces of the blade 56 may be bent. In such embodiments, the degree of bending may be between about 10° to 150°. In other embodiments, the blade 56 may have a curved shape (FIG. 6), e.g., the leading 58 and/or trailing 60 surfaces of the blade 56 may have a smooth curve, as opposed to a sharp bend. In such embodiments, the curve may have a radius of between about 0.25 inches and 20 inches. As will be appreciated, the shapes of the leading surface 58 disclosed herein reduce the amount of kinetic energy, in a direction perpendicular to the rotational axis 42, transferred from the blade 56 to particles contacted by the leading surface 58. As such, the shapes of the leading surface 58 disclosed herein facilitate movement of the particles towards the bowl 20, as opposed towards promoting movement of the particles horizontally out towards the housing 14.

Figure 7:
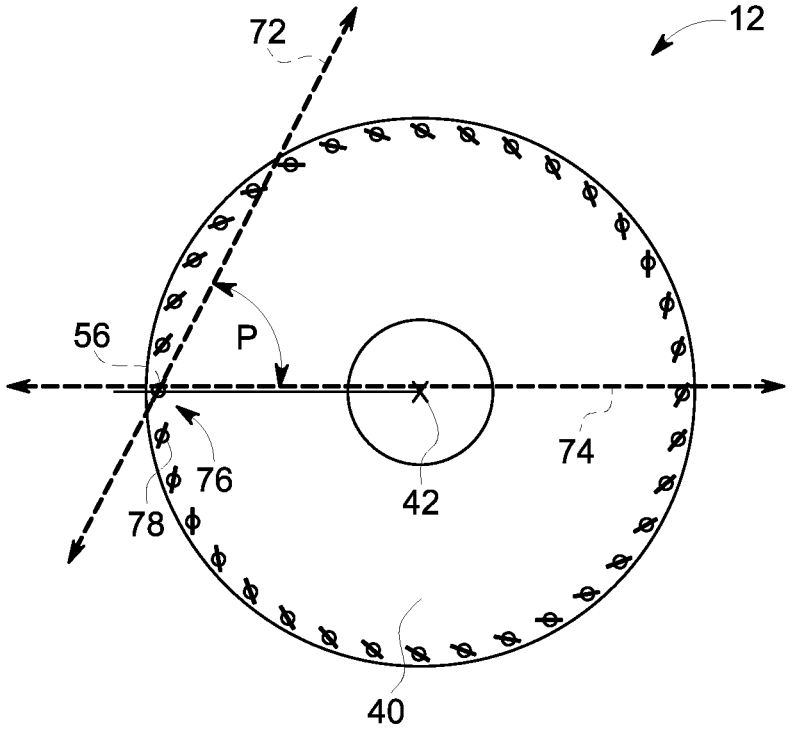
FIG. 7 is another schematic diagram of the top profile of the classifier of FIG. 1, wherein the classifier has a blade with an adjustable pitch in accordance with an embodiment of the present invention.
Figure 8:
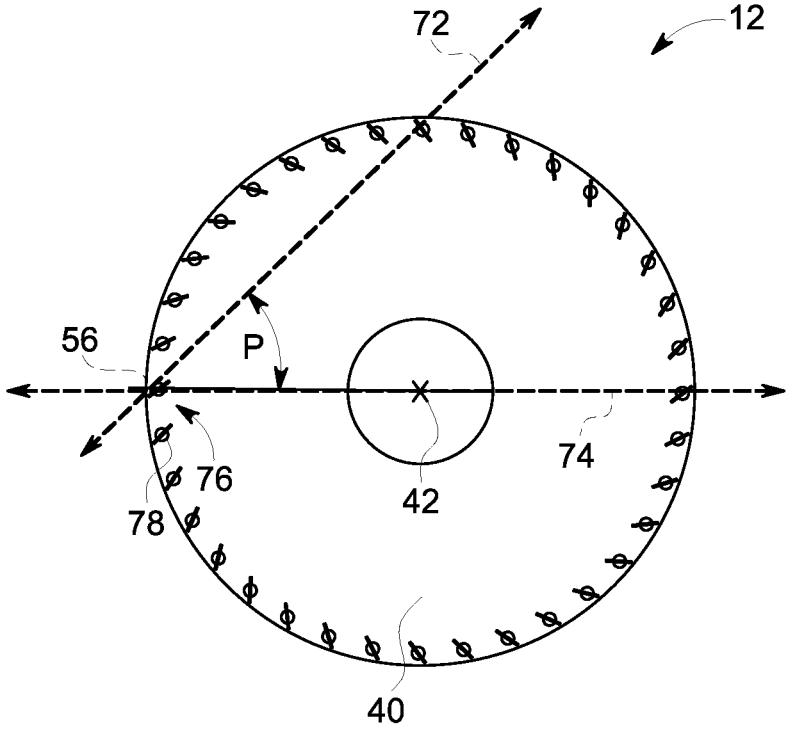
FIG. 8 is another schematic diagram of the top profile of the classifier of FIG. 7.
Figure 9:
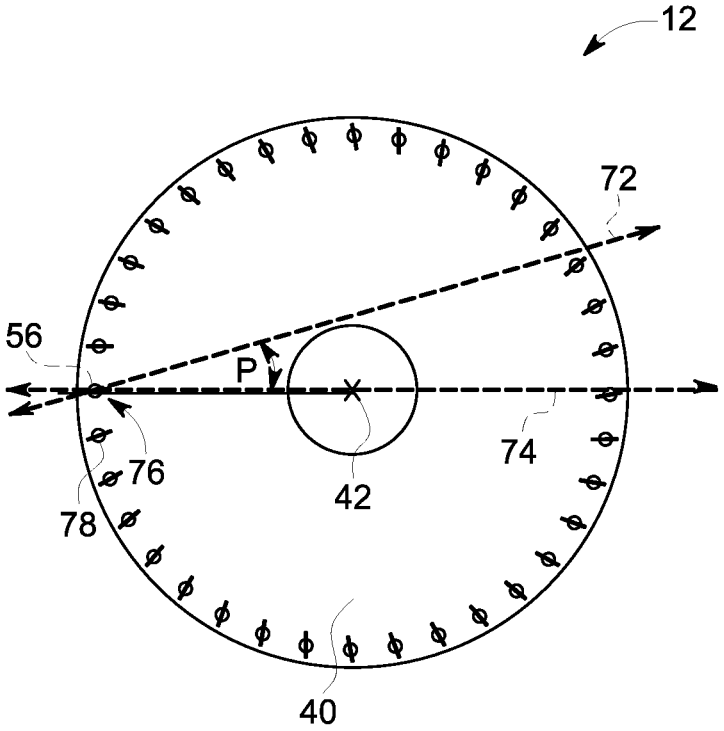
FIG. 9 is another schematic diagram of the top profile of the classifier of FIG. 7.
Figure 10:
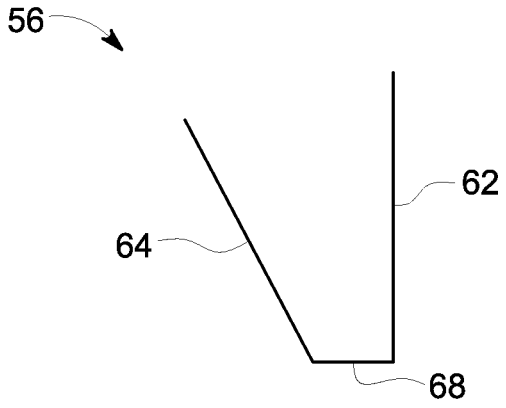
FIG. 10 is a schematic diagram of a blade of the classifier of FIG. 1, wherein the blade has a conical shaped outer profile in accordance with an embodiment of the present invention.
Figure 11:
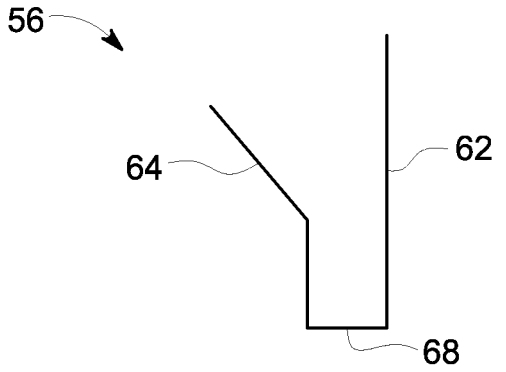
FIG. 11 is another schematic diagram of a blade of the classifier of FIG. 1, wherein the blade has a semi-cylindrical shaped outer profile in accordance with an embodiment of the present invention.
Figure 12:
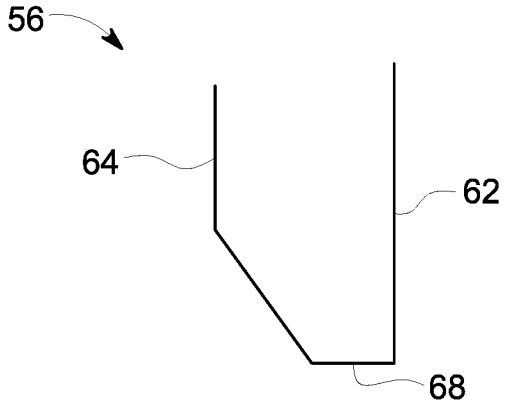
FIG. 12 is another schematic diagram of a blade of the classifier of FIG. 1, wherein the blade has a concaved shaped outer profile in accordance with an embodiment of the present invention.
Figure 13:
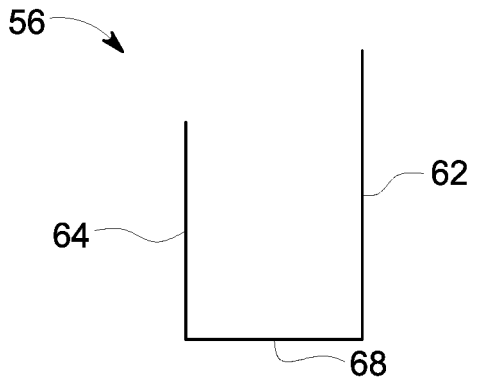
FIG. 13 is another schematic diagram of a blade of the classifier of FIG. 1, wherein the blade has a rectangular shaped outer profile in accordance with an embodiment of the present invention.
Figure 14:
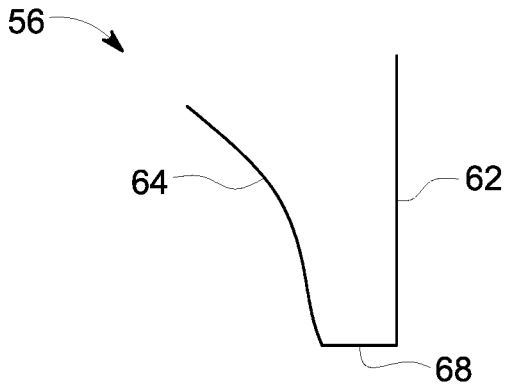
FIG. 14 is another schematic diagram of a blade of the classifier of FIG. 1, wherein the blade has a bell shaped outer profile in accordance with an embodiment of the present invention.
Figure 15:
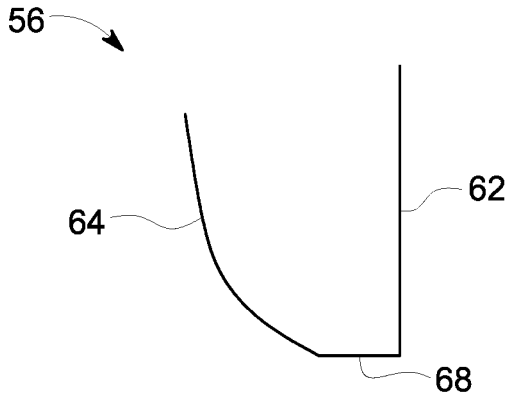
FIG. 15 is another schematic diagram of a blade of the classifier of FIG. 1, wherein the blade has a cup shaped outer profile in accordance with an embodiment of the present invention.

Moving now to FIGS. 7-9, in embodiments, the particle control feature may be an adjustable pitch of the blade 56. As used herein, the pitch of the blade 56 refers to the angle P made by a line 72, that extends through the interior 62 and exterior 64 edges of the blade 56 (best seen in FIG. 4), with a line 74, that extends through the rotational axis 42 and the blade 56. As will be appreciated, the pitch of the blade 56 effects the angle of attack of the blade 56 with respect to the air currents flowing over the blade 56 as the rotor 40 rotates. Accordingly, the pitch of the blade 56 may be adjusted by rotating the blade 56 in place with respect to the rotor 40 via one or more actuators, e.g., electrical motors, rods, gears, hydraulics, pneumatics, and/or other appropriate means of adjustment. As will be appreciated, in embodiments, adjusting the pitch of the blade 56 may provide for control over the fineness grade of the classifier 12 and/or additionally optimize the pressure drop across the classifier, which in turn may optimize the amount of power required to drive/rotate/motor the classifier 12.

For example, when the pitch of the blade 56 is small, e.g., 2.5°, the size of an opening/space 76 between the blade 56 and an adjacent blade 78 may be large, e.g., between about 0.5 inches to 20 inches, and the maximum size of particles allowed to pass through the classifier is large e.g., 10% of residual particles retained on 50 mesh. In other words, a small pitch may result in a low fineness grade. Conversely, when the pitch of the blade 56 is large, e.g., 80°, the size the opening 76 between the blade 56 and the adjacent blade 78 may be small, e.g., between about 0.25 inches to 15 inches, and the maximum size of particles allowed to pass through the classifier is small, e.g., 0% of residual particles retained on 50 mesh. In other words, a large pitch may result in a high fineness grade. Accordingly, in embodiments, the classifier 12 may have a high pitch angle (FIG. 7) resulting in a high fineness grade. The pitch may then be adjusted/decreased to medium angle (FIG. 8) resulting in a medium fineness grade. The pitch may then be further adjusted/decreased to a small angle (FIG. 9) resulting in a low fineness grade and/other benefits, e.g., optimization of the pressure drop across the classifier 12.

Additionally, adjusting the size of the pitch of the blade 56 may also provide for control over the flow rate of fine particles across the classifier 12, i.e., the flow of fine particles from the upstream side 36 to the downstream side 38. For example, in embodiments, a high pitch with a small opening 78 may result in a low flow rate, e.g., 500 lb/hr, across the classifier 12, and a small pitch with a large opening 78 may result in a high flow rate, e.g., 800,000 lb/hr, across the classifier 12. Accordingly, in embodiments, the pitch P may be adjusted between about 2.5° and 80°.

Moving now to FIGS. 10-15, in embodiments, the particle control feature of the blade 56 may be a shaped outer profile of the blade 56 which, as used herein, refers to the design/contour of the exterior edge 64. For example, the exterior edge 64 may have: a conical shape (FIG. 10); a semi-cylindrical shape (FIG. 11); a concaved shape (FIG. 12); a rectangular shape (FIG. 13); a bell shape (FIG. 14); a cup shape (FIG. 15); and/or any combination thereof. While the interior edge 62 is depicted within FIGS. 10-15 as being substantially vertical, it is to be understood that, in embodiments, the interior edge 62 may deviate from being substantially vertical to include following/outlining/tracing/mirroring the design/contour of the exterior edge 64. Similar to the shapes of the leading surface 58 discussed above, as will be appreciated, in embodiments, the aforementioned outer profile shapes may reduce the amount of kinetic energy, in a direction perpendicular to the rotational axis 42, transferred from the blade 56 to particles contacted by the exterior edge 64 of the blade 56. As such, the outer profile shapes disclosed herein facilitate movement of the particles towards the bowl 20, as opposed towards promoting movement of the particles horizontally out towards the housing 14. As such, in embodiments, the outer profile shapes disclosed herein may reduce the likelihood that particle swells will develop near the classifier 12 and/or other regions within the housing 14 of the pulverizer mill 10. In other words, in embodiments, the outer profile shape of the blades 56 reduces the likelihood that dense particle clouds will form around the outside of the classifier 12. Further, in embodiments, the shaped outer profiles of the blades 56 may improve the flow of particles deflected by the classifier 12 back to the bowl 20 which in turn improves grinding performance of the pulverizer mill 10.

Figure 16:
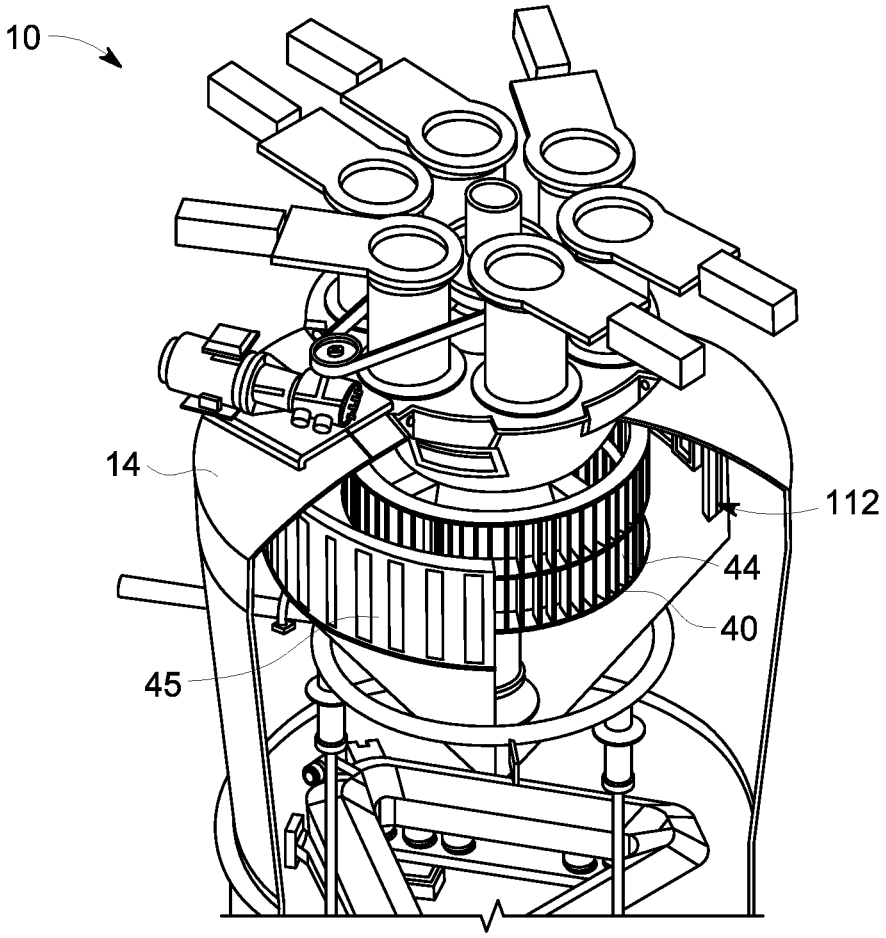
FIG. 16 is another perspective view of the pulverizer mill of FIG. 1, wherein the pulverizer mill includes a classifier in accordance with another embodiment of the present invention.
Figure 17:
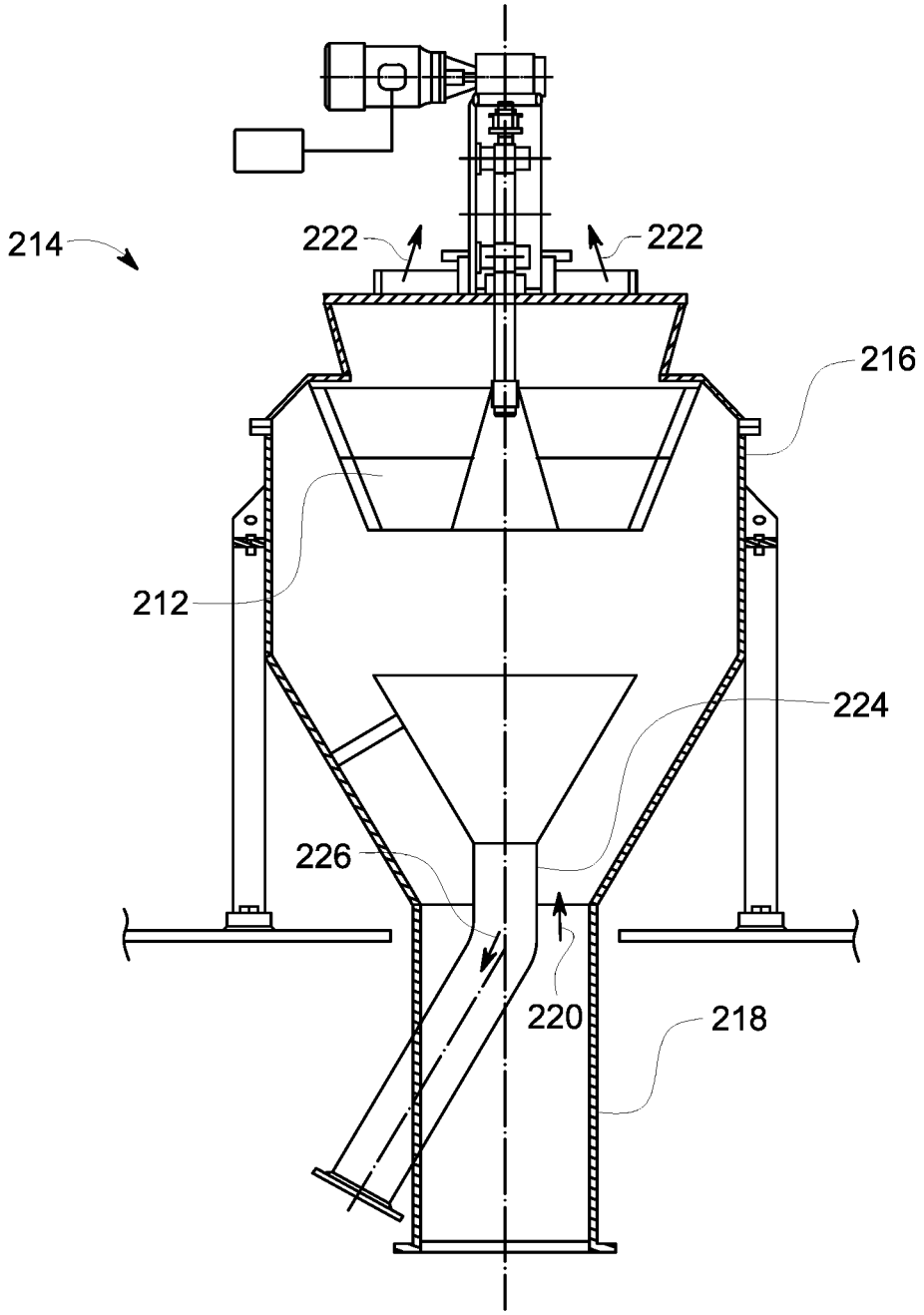
FIG. 17 is a schematic diagram of a tube mill that includes a classifier in accordance with an embodiment of the present invention.

Additionally, while the classifier 12 is shown in FIG. 1 as a single stage dynamic classifier, i.e., the classifier 12 does not include a static stage/filter, it will be understood that in embodiments, the classifier 112, as shown in FIG. 16, may be a two stage dynamic classifier, i.e., the classifier 112 includes a static stage/filter 45 that surrounds the rotor 40 and blades 44. Further, as shown in FIG. 17, in other embodiments, the classifier 212 may be a single stage dynamic classifier for a ball and tube mill 214 which may include a housing 216 separate from the housing 14 of the pulverizer mill 10 (FIG. 1). In such embodiments, the pulverized material/fuel may flow from the pulverizer mill 10 into the tube mill 214 via duct 218 along the path indicated by arrow 220. Particles satisfying the fineness grade of the classifier 212 are allowed to flow through the classifier 212 and out of the top of the tube mill 214 as shown by arrows 222. Particles that do not satisfy the fineness grade are forced/directed by the classifier 212 back into the pulverizer mill 10 via duct 224 along the path indicated by arrow 226.

Finally, it is also to be understood that the pulverizer mill 10 and/or the classifier 12 may include the necessary electronics, software, memory, storage, databases, firmware, logic/state machines, microprocessors, communication links, displays or other visual or audio user interfaces, printing devices, and any other input/output interfaces to perform the functions described herein and/or to achieve the results described herein. For example, as stated above, the pulverizer mill 10 may include at least one processor 30 and system memory/data storage structures 32 in the form of a controller 28. The memory may include random access memory ("RAM") and read-only memory ("ROM"). The at least one processor may include one or more conventional microprocessors and one or more supplementary co-processors such as math co-processors or the like. The data storage structures discussed herein may include an appropriate combination of magnetic, optical and/or semiconductor memory, and may include, for example, RAM, ROM, flash drive, an optical disc such as a compact disc and/or a hard disk or drive.

Additionally, a software application that provides for control over one or more of the various components of the pulverizer mill 10 and/or classifier 12, e.g., the pitch of the blade 56, may be read into a main memory of the at least one processor from a computer-readable medium. The term "computer-readable medium", as used herein, refers to any medium that provides or participates in providing instructions to the at least one processor 30 (or any other processor of a device described herein) for execution. Such a medium may take many forms, including but not limited to, non-volatile media and volatile media. Non-volatile media include, for example, optical, magnetic, or opto-magnetic disks, such as memory. Volatile media include dynamic random access memory ("DRAM"), which typically constitutes the main memory. Common forms of computer-readable media include, for example, a floppy disk, a flexible disk, hard disk, magnetic tape, any other magnetic medium, a CD-ROM, DVD, any other optical medium, a RAM, a PROM, an EPROM or EEPROM (electronically erasable programmable read-only memory), a FLASH-EEPROM, any other memory chip or cartridge, or any other medium from which a computer can read.

While in embodiments, the execution of sequences of instructions in the software application causes the at least one processor to perform the methods/processes described herein, hard-wired circuitry may be used in place of, or in combination with, software instructions for implementation of the methods/processes of the present invention. Therefore, embodiments of the present invention are not limited to any specific combination of hardware and/or software.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment, a classifier for separating particles is provided. The classifier includes a rotor having a direction of rotation defined by a rotational axis of the rotor, and a plurality of blades disposed on the rotor around the rotational axis. At least one blade of the plurality has a swept orientation in the direction of rotation. The at least one blade is arranged to contact and direct the particles away from the classifier and thereby restrict the particles from concentrating in areas adjacent to the classifier. In certain embodiments, a leading surface of the at least one blade is angled down such that a top edge of the at least one blade leads a bottom edge of the at least one blade along the direction of rotation. The top edge and the bottom edge are adjacent to a downstream side of the classifier and an upstream side of the classifier, respectively. In certain embodiments, the at least one blade has a shaped leading surface. In certain embodiments, the shaped leading surface is angled. In certain embodiments, the shaped leading surface is curved. In certain embodiments, the at least one blade has an adjustable pitch. In certain embodiments, the at least one blade has a shaped outer profile having a shape that is at least one of conical, semi-cylindrical, concaved, bell, and cup. In certain embodiments, the classifier is disposed in a pulverizer mill and the particles are produced via pulverizing a fuel in the pulverizer mill.

Other embodiments provide for a method for separating particles. The method includes: forcing the particles against an upstream side of a classifier that includes a rotor and a plurality of blades disposed on the rotor around a rotational axis of the rotor that defines a direction of rotation of the rotor; rotating the rotor in the direction of rotation such that a first stream of the particles flows between the plurality of blades from the upstream side to a downstream side of the classifier, and such that a second stream of the particles is restricted from flowing between the plurality of blades from the upstream side to the downstream side; and restricting the particles from concentrating in areas adjacent to the classifier via contacting the particles with at least one blade of the plurality that has a swept orientation in the direction of rotation that directs the particles away from the classifier. In certain embodiments, a leading surface of the at least one blade is angled down such that a top edge of the at least one blade leads a bottom edge of the at least one blade along the direction of rotation. The top edge and the bottom edge are adjacent to the downstream side and the upstream side, respectively. In certain embodiments, the at least one blade has a shaped leading surface. In certain embodiments, the shaped leading surface is angled. In certain embodiments, the shaped leading surface is curved. In certain embodiments, the at least one blade has an adjustable pitch, and the method further includes adjusting the pitch of the at least one blade. In certain embodiments, the at least one blade has a shaped outer profile having a shape that is at least one of conical, semi-cylindrical, concaved, bell, and cup. In certain embodiments, the classifier is disposed in a pulverizer mill and the method further includes pulverizing a fuel so as to generate the particles.

Yet still other embodiments provide for a pulverizer mill. The pulverizer mill includes a classifier that includes a rotor having a direction of rotation defined by a rotational axis of the rotor. The classifier further includes a plurality of blades disposed on the rotor around the rotational axis. At least one blade of the plurality has a swept orientation in the direction of rotation. The at least one blade is arranged to contact and direct the particles away from the classifier and thereby restrict the particles from concentrating in areas adjacent to the classifier. In certain embodiments, the pulverizer mill forms part of a boiler and generates the particles by pulverizing a solid fuel arranged to be burned by the boiler. In certain embodiments, the swept orientation of the at least one blade is between about 5° to 80° with respect to the direction of rotation. In certain embodiments, the at least one blade has at least one of a shaped leading surface and a shaped outer profile.

Accordingly, by incorporating one or more particle control features into the blades of a classifier, some embodiments of the present invention reduce the likelihood of swirls forming in the upper regions of a pulverizer mill which in turn may reduce wear on the pulverizer mill and its components. In other words, some embodiments of the present invention may reduce the size and/or number of coarse particles that swell around the classifier, i.e., some embodiments improve the turbulence of the particles so as to reduce and/or eliminate dense concentrations of particles around the classifier. Additionally, the one or more particles control features disclosed herein may also improve the ability of a classifier to separate fine from coarse particles.

Further, by adjusting the pitch of the blades of a classifier, some embodiments of the present invention provide for the ability to change the fineness grade of the classifier and/or the flow rate of fine particles across the classifier while the classifier continuously rotates. Accordingly, such embodiments may decrease the pressure drop across the classifier, i.e., the difference in pressure between the upstream and downstream sides, which may in turn decreases the overall power utilized to drive the classifier. For example, in some embodiments, the downward deflection of coarse particles may provide for a reduction in the amount of, and pressure of, forced air introduced into the housing via the air inlet ducts, thus improving the classifier's efficiency.

Additionally, the reduction of particles swells, in some embodiments, may reduce the likelihood of coarse particles inadvertently passing through the classifier, and/or facilitate improved particle flow through the housing and across the classifier. Thus, some embodiments may improve both quality of the fineness grade, efficiency and/or capacity of the classifier.

Further, it will be appreciated that the particle control features disclosed herein are directed towards both improving finesse control and in preventing the formation of swirls near the classifier, as opposed to many traditional classifier designs which have been primarily focused on improving only fineness.

It will be further understood that the above mentioned features may be implemented in newly constructed pulverizer mills, and/or by retrofitting pre-existing pulverizer mills with a classifier in accordance with the embodiments described herein.

While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

What is claimed is:

1. A classifier for separating particles comprising:

a rotor having a direction of rotation defined by a rotational axis of the rotor;

a plurality of blades disposed on the rotor around the rotational axis; and wherein at least one blade of the plurality has a swept orientation in the direction of rotation, the at least one blade arranged to contact and direct a first plurality of the particles each having a larger size than a desired fineness grade away from the classifier and thereby restrict the first plurality of particles from concentrating in areas adjacent to the classifier while allowing a second plurality of the particles each having a size equal to or smaller than the desired fineness grade to pass between two blades of the plurality of blades; and wherein the at least one blade has a leading surface with at least one of a curved and angled shape having an apex that faces the direction of rotation of the rotor.

2. The classifier of claim 1, wherein a leading surface of the at least one blade is angled down such that a top edge of the at least one blade leads a bottom edge of the at least one blade along the direction of rotation, the top edge and the bottom edge being adjacent to a downstream side of the classifier and an upstream side of the classifier, respectively.

3. The classifier of claim 1, wherein the shaped leading surface is angled.

4. The classifier of claim 1, wherein the shaped leading surface is curved.

5. The classifier of claim 1, wherein the at least one blade has an adjustable pitch.

6. The classifier of claim 1, wherein the at least one blade has a shaped outer profile having a shape that is at least one of conical, semi-cylindrical, concaved, bell, and cup.

7. The classifier of claim 1, wherein the classifier is disposed in a pulverizer mill and the particles are produced via pulverizing a fuel in the pulverizer mill.

8. A method for separating particles comprising:

forcing the particles against an upstream side of a classifier that includes a rotor and a plurality of blades disposed on the rotor around a rotational axis of the rotor that defines a direction of rotation of the rotor;

rotating the rotor in the direction of rotation such that a first stream of the particles flows between the plurality of blades from the upstream side to a downstream side of the classifier, and such that a second stream of the particles is restricted from flowing between the plurality of blades from the upstream side to the downstream side; and restricting particles of the second stream from concentrating in areas adjacent to the classifier via contacting the particles of the second stream with at least one blade of the plurality that has a swept orientation in the direction of rotation that directs the particles of the second stream away from the classifier;

wherein the particles of the first stream are each of a size equal to or smaller than a desired fineness grade and the particles of the second stream are each of a size larger than the desired fineness grade; and wherein the at least one blade has a leading surface with at least one of a curved and angled shape having an apex that faces the direction of rotation of the rotor.

9. The method of claim 8, wherein a leading surface of the at least one blade is angled down such that a top edge of the at least one blade leads a bottom edge of the at least one blade along the direction of rotation, the top edge and the bottom edge being adjacent to the downstream side and the upstream side, respectively.

10. The method of claim 8, wherein the shaped leading surface is angled.

11. The method of claim 8, wherein the shaped leading surface is curved.

12. The method of claim 8, wherein the at least one blade has an adjustable pitch, and the method further comprises:

adjusting the pitch of the at least one blade.

13. The method of claim 8, wherein the at least one blade has a shaped outer profile having a shape that is at least one of conical, semi-cylindrical, concaved, bell, and cup.

14. The method of claim 8, wherein the classifier is disposed in a pulverizer mill and the method further comprises:

pulverizing a fuel so as to generate the particles.

15. A pulverizer mill comprising:

a classifier that includes a rotor having a direction of rotation defined by a rotational axis of the rotor, the classifier further includes a plurality of blades disposed on the rotor around the rotational axis; and wherein at least one blade of the plurality has a swept orientation in the direction of rotation, the at least one blade arranged to contact and direct a first plurality of particles each having a size larger than a desired fineness grade away from the classifier and thereby restrict the first plurality of particles from concentrating in areas adjacent to the classifier while allowing a second plurality of particle each having a size equal to or smaller than the desired fineness grade to pass between two blades of the plurality of blades wherein the at least one blade has a leading surface with at least one of a curved and angled shape having an apex that faces the direction of rotation of the rotor, and the at least one blade exhibits a shaped outer profile that is substantially the same from a top edge to a bottom edge.

16. The pulverizer mill of claim 15, wherein the pulverizer mill forms part of a boiler and generates the particles by pulverizing a solid fuel arranged to be burned by the boiler.

17. The pulverizer mill of claim 15, wherein the swept orientation of the at least one blade is between about 5° to 80° with respect to the direction of rotation.

* * * * *